US005333873A

United States Patent [19]

Burke

[11] Patent Number: 5,333,873

[45] Date of Patent: Aug. 2, 1994

[54] BULGE PUTTER

[76] Inventor: Alan W. Burke, 5524 Cedar Break Dr., Centreville, Va. 22020

[21] Appl. No.: 925,292

[22] Filed: Aug. 6, 1992

Related U.S. Application Data

[63] Continuation of Ser. No. 757,617, Sep. 11, 1991, abandoned.

[51] Int. Cl.[5] ..... A63B 53/04

[52] U.S. Cl. ..... 273/175; 273/164.1; 273/167 J

[58] Field of Search ..... 273/167 R, 167 J, 175, 273/163 R, 164.1, 78, 169, 167 F, 168

[56] References Cited

U.S. PATENT DOCUMENTS

| | | | |
|---|---|---|---|
| D. 190,745 | 6/1961 | Reuter, Jr. | 273/167 J |
| D. 209,760 | 1/1968 | Andis | D21/220 |
| D. 264,855 | 6/1982 | Morgan, Sr. | D21/219 |
| D. 285,818 | 9/1986 | Moore | D21/219 |
| 1,615,038 | 1/1927 | Reuter, Jr. | 273/175 |
| 2,395,837 | 3/1946 | Baymiller et al. | 273/175 |
| 3,043,596 | 7/1962 | Ehmke | 273/163 R |
| 3,360,268 | 12/1967 | Molinari | 273/163 R |
| 3,625,518 | 12/1971 | Solheim | 273/175 |
| 3,989,257 | 11/1976 | Barr | 273/175 |
| 4,413,825 | 11/1983 | Sasse | 273/175 |
| 4,471,961 | 9/1984 | Masghati et al. | 273/175 |
| 4,521,022 | 6/1985 | Schmidt | 273/77 A |

OTHER PUBLICATIONS

"Straighter Shots From Curved Clubfaces," Golf Digest, Jul. 1965, pp. 70–75.

*Primary Examiner*—V. Millin
*Assistant Examiner*—Steven B. Wong
*Attorney, Agent, or Firm*—James Creighton Wray

[57] ABSTRACT

A bulge putter has a substantially flat base which is curved upwardly at longitudinal ends and which is sloped slightly upwardly and rearwardly from a front lower edge of the putter. A face extends upwardly and slightly rearwardly from the lower forward edge of the putter. A first portion of the face near a hosel end of the face is substantially flat. A second portion of the face, which extends outward toward a toe of the putter remote from the hosel, is curved outward and rearward for directing a ball struck with a putter face in an intended line of roll when the putter is moved off center and is swung in an inexact arc.

14 Claims, 2 Drawing Sheets

FIG. 1
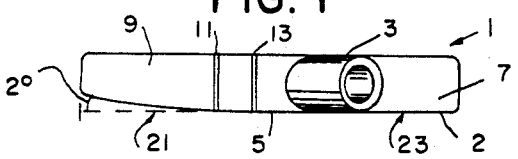
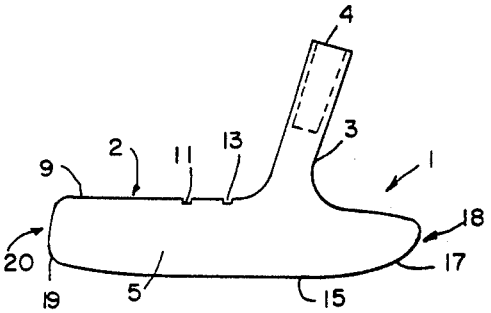
FIG. 2
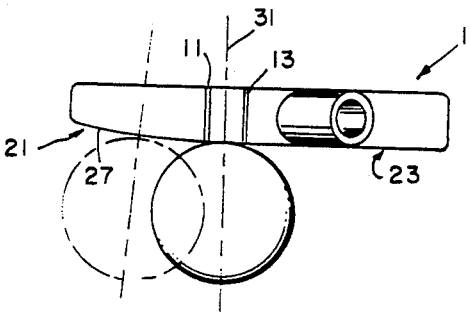
FIG. 3
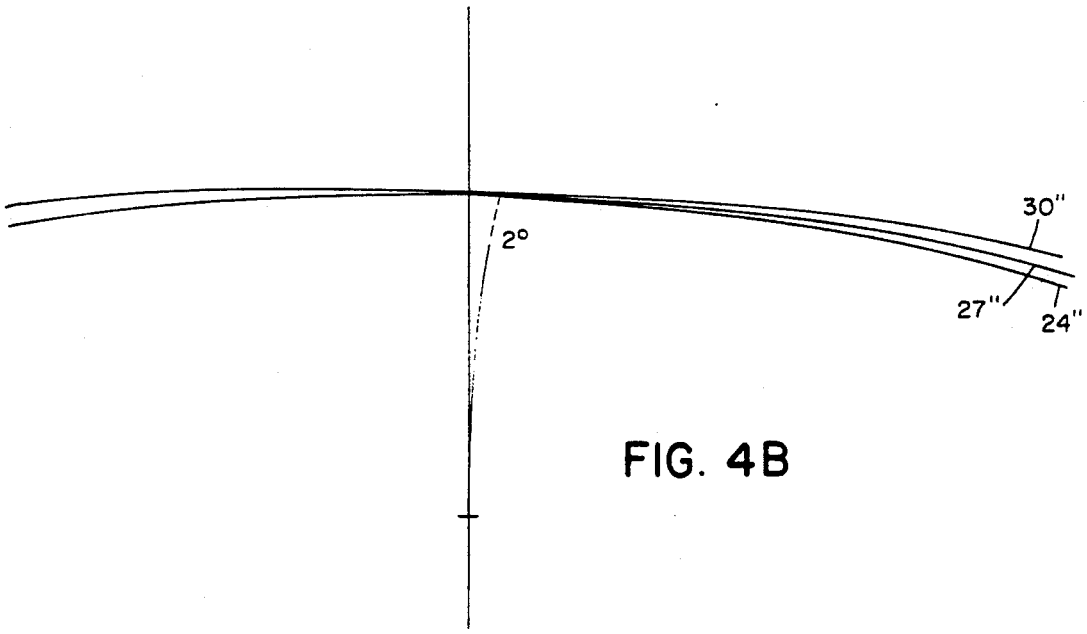
FIG. 4B

FIG. 5
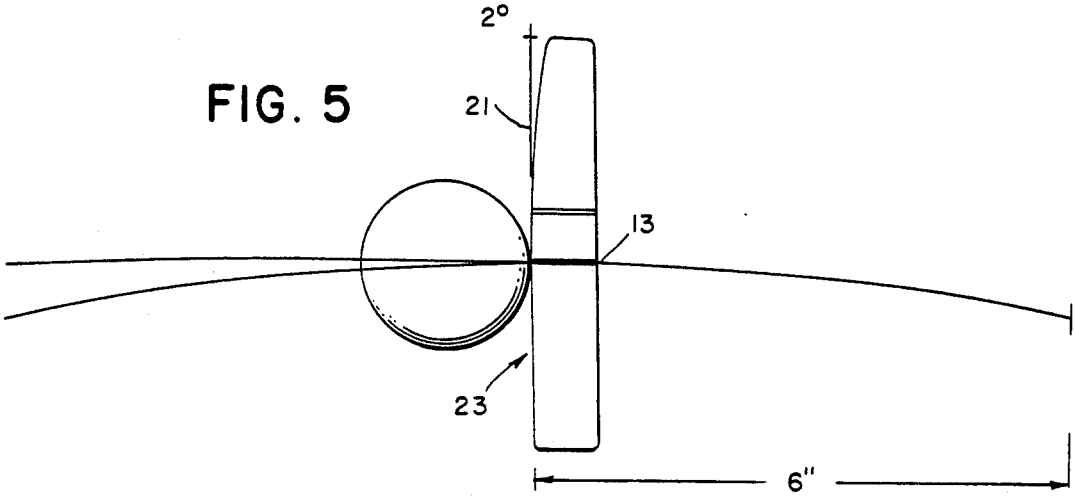
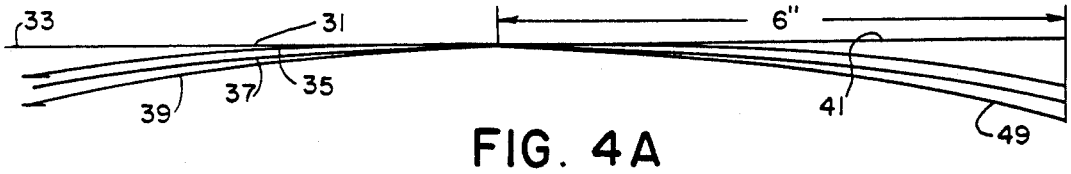
FIG. 4A
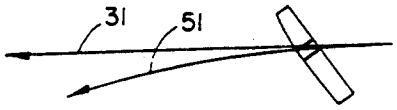
FIG. 6
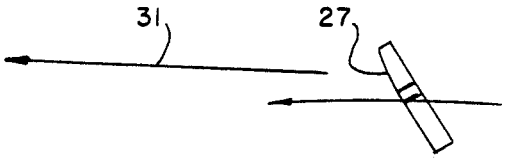
FIG. 7

BULGE PUTTER

This application is a continuation of Ser. No. 07/757,617, filed Sep. 11, 1991, now abandoned.

BACKGROUND OF THE INVENTION

This invention relates to golf putters, and particularly to the automatic redirection of a ball in response to an unintentional change in the intended swing arc.

The science of golf putters is well developed.

A large number of golf putter configurations are available from pro shops and stores. Each of the putters is directed to improving the feel, repeatability and accuracy of golf strokes, and promoting the ability of accelerating a putter face through a golf ball so that the proper momentum and direction may be imparted to the ball to strike the ball toward a target.

Alignment marks on upper surfaces of the putter direct the proper positioning of the putters adjacent the balls before the backswings. Marks on top of putters also provide visual reinforcement at the time that the putter strikes the ball. Marks on top of the putter head are not visible during the backswing, or should not be preeminent in the golfer's mind, since the attention should be focused directly on the ball.

Whether or not the marks are visually perceivable during the swing, problems are encountered in making reproducible putter swings or strokes.

At the moment of contact with the ball during a putting stroke, the face of the putter should be perpendicular to the intended line to the virtual target. The virtual target may be some point offset from the hole to compensate for slope of the green. When the stroke line is off the intended line, the face of the putter is often canted, making the ball travel in an unintended direction.

The present invention is directed to overcoming the problems that exist in the prior art and to automatically compensating for mis-struck putts.

SUMMARY OF THE INVENTION

The putter of the present invention differs substantially from conventional style putters on the market today. This putter is precision machined with a slight horizontal bulge from the center of the putter blade to the toe. The bulge corresponds to the arc of a golfer's putting stroke. Two sight lines are added to the top of the blade; one at the center of the putter blade at the point where the bulge begins, and another one-half inch from center on the bulge toward the toe.

This new concept can be machined on most putters that are on the market today. However, the length of the putter head should be limited to a maximum of five and one-half inches.

The majority of golfers do not have the ability to stroke a putt exactly like a pendulum. Rather, a natural putting stroke tends to swing in an arc; "open-to-close". As a result there is a tendency to pull a lot of putts. The bulge putter significantly reduces this problem.

Additionally, for right-handed golfers with conventional putters, balls stroked on the inside of center will travel left of the intended line to the hole. During practice sessions on the putting green with a conventional putter machined to specifications, it was found that those putts hit on the heel side of center continued on the intended line to the hole, or nearly so. In addition, a golfer tends to concentrate more on striking the ball within the sight lines, because of the bulge, resulting in considerably more successful putts.

It is noted that Spaulding's toe-weighted High Efficiency Putters are the result of tests that show the average golfer almost always makes impact farther from the heel than intended. The bulge putter is designed to compensate for putts hit toward the toe.

Tests performed on a relatively flat putting green showed that pulled putts are reduced as much as 50 percent or more. Testing with putts stroked with a straight putter resulted in 30 percent travelling on a line left of center and 14 percent travelling right of center. Of putts stroked with the bulge putter, only 14 percent went left of center and 14 percent went right of center.

There is an enormous potential sales volume for this product as there are approximately 3,000,000 putters sold each year. Additionally, this product can be produced to sell for a price the public will pay.

A bulge putter has a substantially flat base which is curved upwardly at longitudinal ends and which is sloped slightly upwardly and rearwardly from a front lower edge of the putter. A face extends upwardly and slightly rearwardly from the lower forward edge of the putter. A first portion of the face near a hosel end of the putter is substantially flat. A second portion of the face, which extends outward toward a toe of the putter remote from the hosel, is curved outward and rearward for directing a ball struck with a putter face in an intended line of roll when the putter is moved off center and is swung in an inexact arc.

The present invention provides an improved putter and putter head. An elongated putter face is formed on the putter head. A hosel is attached to the putter. A shaft receiver on the hosel receives a shaft. The putter has an elongated putter body with a heel portion at one end and a toe portion at the other end. The putter face has a preferred ball striking area. The putter face is substantially flat from the heel portion to the striking area. The facial area extending from the striking area to the toe portion is receded for impacting a ball toward an intended line of roll when the putter is moved along a line nearer a user than an intended line of movement.

In a preferred embodiment, the receded facial area is curved outward and rearward from the preferred striking area.

In another embodiment, the receded area is sloped outwardly and rearwardly with respect to the flat surface.

Alternatively, the receded face is curved rearwardly and then sloped rearwardly and outwardly in a flat sloping area toward the toe.

In a preferred putter head, a medial portion of the upper surface is marked with a transverse alignment mark, which terminates in a top of the putter face directly above a preferred ball-striking area of the putter face. A second alignment mark on the upper surface is parallel to the first alignment mark and is spaced outward toward the toe portion from the first alignment mark. The putter face is curved rearwardly and outwardly between the first and second alignment marks. The putter preferably has a flat area on the putter face between the first and second alignment marks.

A preferred putter has a putter body with a base, a top, a back and a putter face, all extending between a heel portion and a toe portion. A hosel extends upward from the top of the putter body between a middle portion of the top and the heel portion. The putter face is substantially flat from a middle portion of the face to the heel portion, and the putter face has a receding area extending from the middle portion to the toe portion.

Preferably the receding portion extends at an angle of about 2° from the flat face of the putter, which extends from the middle portion to the heel portion.

The preferred method of putting includes striking a ball with a flat putter face in a preferred ball-striking area of a face of a putter, and striking the ball with a receded putter face when a ball is struck between a preferred putting area and a toe portion of a putter.

A bulge putter has a substantially flat base which is curved upwardly at longitudinal ends and which is sloped slightly upwardly and rearwardly from a front lower edge of the putter. A face extends upwardly and slightly rearwardly from the lower forward edge of the putter. A first portion of the face near a hosel end of the face is substantially flat. A second portion of the face, which extends outward toward a toe of the putter remote from the hosel, is curved outward and rearward for directing a ball struck with a putter face in an intended line of roll when the putter is moved off center and is swung in an inexact arc.

These and further and other objects and features of the invention are apparent in the disclosure, which includes the above and ongoing written specification, with the claims and the drawings.

BRIEF DESCRIPTION OF THE DRAWINGS

FIG. 1 is a top plan view of a putter of the present invention.

FIG. 2 is a front elevation of the putter shown in FIG. 1.

FIG. 3 is a detail of the putter shown in FIG. 1 showing the face in contact with the ball.

FIG. 4A is a theoretical vertical view showing stroke and ball travel variations in a 6" backswing.

FIG. 4B shows corrections by the present invention.

FIG. 5 is a schematic of an intended swing.

FIG. 6 shows ball travel variations due to a closed face.

FIG. 7 shows a corrected ball path according to the present invention.

DETAILED DESCRIPTION OF THE DRAWINGS

Referring to the drawings, a putter is generally indicated by the numeral 1. The putter shown in the drawings is a blade-type putter. Other putters of differing configurations may be used. For example, a popular putter with an offset hosel, a relatively thin blade striking surface, and enlarged heel and toe weighted portions and a broad base, may be used with the present invention. The blade putter 1 shown in the drawing has a body 2 with a hosel 3, which has a shaft-receiving socket 4. The front or striking face of the putter is generally indicated by the numeral 5. The rear 7 of the putter shown in the drawing is substantially planar. The top of the putter 9 has parallel ball alignment markings 11 and 13. The base 15 of the putter has a rounded portion 17 near the heel 18, and a rounded portion 19 near the toe portion 20 of the putter. In a preferred embodiment of the putter, the striking face 5 is divided into a toe portion 21 and a heel portion 23.

The putter shown in FIG. 1 is formed with a sloped toe portion 21 which slopes away from the planar heel portion 23. In one embodiment of the invention, the slope begins at the center sight line 13 and continues as a curved portion 25 until the second slight line 11, which is one half inch toward the toe from the center sight line 13. Thereafter the outer portion 27 of the slope 21 continues as a substantially flat wall, which is angled at about 2° to the face 23. In one embodiment of the invention, the entire face portion 21 curved on a gradient which is tangent to face portion 23 at sight line 11. In another embodiment of the invention, the portion 25 of the face between the two sight lines is curved, and the outer portion 27 of the face is flat.

In preferred embodiments of the invention, the putters using the invention are of varied conventional forms. The body 2 may be elongated between the front face 5 and the rear face 7. The putter may be enlarged at the sole so that the sole portion 15 is larger than the top 9. Weighted portions at the heel 18 and toe 20 may be applied or cast at the back of the face, and the thickness of the putter may be thinned at the ball-striking area.

As shown in FIG. 3, the stroke of a putter is usually tangent to the line 31 to the virtual target 33, which may or may not be the actual hole, depending on the slope of the green. Longer putter shafts tend to have longer radiuses of swing. For example, as in FIG. 4A, a 36" putter shaft has a swing radius schematically shown as 35. Gripping down to a 30" putter length creates a stroke radius which produces a path generally indicated by the numeral 37. Gripping down to an even shorter putter length, for example to 24" length, may produce a stroke arc 39 having a reduced radius. In six inches of travel, the lateral differences between the radiuses may be about three inches. In a six inch backswing 41 with a 24" shaft, the back portion 49 of the swing arc may be displaced about ¾" from the nominal backswing line 41, which is an extension of an intended target line 31 to the virtual target 33.

FIG. 4 schematically compares the putter of the present invention with the swing arcs for different length shafts. It can be seen that, as the putter is moved along the arcs, the face of the putter moves from an open position to a closed position.

In the usual procedure, some variation of the preferred arcs are followed. In some cases, the arcs become enlarged so that the center of the putter is outside of the target line. In that case, the arcs are enlarged and it is usually found that, as the putter strikes the ball inside of the intended center line, the putter face is straight and perpendicularly intersects the intended target line. The ball is therefore struck on the flat portion 23 of the putter face 5, which is perpendicular to the intended target line.

In FIG. 4B, which shows more usual cases, the radiuses of the intended swing arcs become unintentionally shortened, perhaps because of the gravitational effect of the putter head, which is cantilevered outward by the hands of the golfer and the shaft. As the arc becomes shortened, there is a tendency to the close the face of the putter, as shown in FIG. 6, causing the initial roll of the ball to be deflected away from the intended line 31 to the incorrect line 51. The average line of deflection has been found through experimentation to be approximately 2°. Thus, in FIG. 5, if the arc is enlarged as in the previous case and the ball and putter meet at heel portion 23 of the putter perpendicular to the target, the putt is still reasonably on line. However, in the latter case of the shortened arc wherein the ball and putter meet on the toe portion, normal putters cause a 2° course misdirection. This is compensated by the slope of 2° of the present invention. The optimal swing, of course, provides for meeting of the putter and ball at center line 13, perpendicular to the target.

As shown again by FIG. 7, the present invention compensates for that tendency by striking the ball on the outwardly and rearwardly sloping portion 27 of the face, which is then substantially normal to the target line 31.

While the invention has been described with reference to a blade putter, any type of putter may be used. While the invention is described with a slope or curvature, either or both may be used. For example, the outward portion of the putter face immediately to the center line may be slightly rounded in a large radius arc, and the outer portion of the face may form a straight line. The arcuate portion may join the generally planar surfaces 23 and 27.

In preferred embodiments of the invention, the remainder of the putters are formed in conventional styles. It is conventional, for example, to have the putter face sloped slightly rearward and upward and to have the sole sloped slightly upward and rearward.

When the putter face is sloped slightly rearward and upward, both planar portions 23 and 27 are so sloped. When the two planar portions are joined by a curved portion, the curved portion is slightly sloped upward and rearwardly.

While the invention has been described with reference to specific embodiments, modifications and variations of the invention may be constructed without departing from the scope of the invention, which is defined in the following claims.

I claim:

1. A putter comprising a putter head, an elongated thin blade putter face on the putter head, and a hosel attached to the putter head, a shaft receiver on the hosel for receiving a shaft, the putter having an elongated putter head with a heel portion at one end and a toe portion at the other end, the putter face having a preferred striking area at a substantially medial portion of the face, the putter face being substantially flat from the heel portion to the striking area, and the putter face having a receded facial area extending from the preferred striking area at the substantially medial portion of the face to the toe portion for impacting a ball toward an intended line of roll when the putter is moved along a line nearer a user than an intended line of movement.

2. The putter of claim 1, wherein the receded facial area is curved outward towards the toe and rearward from the preferred striking area.

3. The putter of claim 1, wherein the receded area is sloped outwardly and rearwardly with respect to the flat face.

4. The putter of claim 1, wherein the receded face is curved rearwardly and then sloped rearwardly and outwardly in a flat sloping area toward the toe.

5. The putter of claim 4, wherein the putter head has an upper surface, and wherein a medial portion of the upper surface is marked with a transverse alignment mark, which terminates in a top of the putter face directly above a preferred ball-striking area of the putter face.

6. The putter of claim 5, further comprising a second alignment mark on the upper surface parallel to the first alignment mark and spaced outward toward the toe portion from the first alignment mark, and wherein the putter face is curved rearwardly and outwardly between the first and second alignment marks.

7. The putter of claim 6, comprising a flat area on the putter face between the first and second alignment marks.

8. A putter comprising a putter having a thin blade body with a base, a top, a back and a putter face extending between a heel portion and a toe portion, a hosel extending upward from the top of the putter body between a middle portion of the top and the heel portion, the putter face being substantially flat from a middle portion of the face to the heel portion, and the putter face having a receding area extending from the middle portion of the face to the toe portion for impacting a ball toward an intended line of roll when the putter is moved along a line nearer a user than an intended line of movement.

9. The putter of claim 8, wherein the receded facial area is curved outward and rearward from the preferred striking area.

10. The putter of claim 8, wherein the receded area is sloped outwardly and rearwardly with respect to the flat face.

11. The putter of claim 8, wherein the receded face is curved rearwardly and then sloped rearwardly and outwardly in a flat sloping area toward the toe.

12. The putter of claim 11, wherein the putter head has an upper surface, and wherein a medial portion of the upper surface is marked with a transverse alignment mark, which terminates in a top of the putter face directly above a preferred ball-striking area of the putter face.

13. The putter of claim 12, further comprising a second alignment mark on the upper surface parallel to the first alignment mark and spaced outward toward the toe portion from the first alignment mark, and wherein the putter face is curved rearwardly and outwardly between the first and second alignment marks.

14. The putter of claim 8, wherein the receding portion extends at an angle of about 2° from the flat face of the putter, which extends from the middle portion to the heel portion.

* * * * *